US009139346B2

(12) United States Patent
Doyle

(10) Patent No.: US 9,139,346 B2
(45) Date of Patent: Sep. 22, 2015

(54) PROCESS FOR FILLING A CAN

(71) Applicant: Crown Packaging Technology, Inc., Alsip, IL (US)

(72) Inventor: Gerry Patrick Doyle, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/355,333

(22) PCT Filed: Oct. 8, 2012

(86) PCT No.: PCT/EP2012/069872

§ 371 (c)(1),
(2) Date: Apr. 30, 2014

(87) PCT Pub. No.: WO2013/064334

PCT Pub. Date: May 10, 2013

(65) Prior Publication Data

US 2014/0287107 A1 Sep. 25, 2014

(30) Foreign Application Priority Data

Nov. 2, 2011 (EP) ..... 11187538

(51) Int. Cl.

| | |
|---|---|
| ***B65D 77/20*** | (2006.01) |
| ***B65B 61/02*** | (2006.01) |
| ***B65B 7/16*** | (2006.01) |
| ***B65B 7/28*** | (2006.01) |

(52) U.S. Cl.

CPC ..... *B65D 77/2032* (2013.01); *B65B 7/168* (2013.01); *B65B 7/28* (2013.01); *B65B 7/2842* (2013.01); *B65B 61/025* (2013.01)

(58) Field of Classification Search

CPC ..... B65D 77/2032; B65B 7/28; B65B 7/168; B65B 7/2842; B65B 61/025; B65B 1/00; B65B 1/04; B65B 1/24; B65B 7/285; B30B 15/00; B30B 15/02; B30B 15/06; B30B 9/00; B30B 9/28

USPC ..... 53/471, 436, 526, 527; 426/131, 396, 426/383

See application file for complete search history.

(56) References Cited

U.S. PATENT DOCUMENTS

| | | | | | |
|---|---|---|---|---|---|
| 290,013 | A | * | 12/1883 | Elder | 53/436 |
| 3,100,957 | A | * | 8/1963 | King et al. | 53/67 |
| 3,410,699 | A | * | 11/1968 | Peters | 426/104 |

(Continued)

FOREIGN PATENT DOCUMENTS

| | | | | |
|---|---|---|---|---|
| GB | 2107291 | A | * | 4/1983 |
| WO | WO 2013064334 | A1 | * | 5/2013 |

*Primary Examiner* — Rena L Dye
*Assistant Examiner* — Ashley Axtell
(74) *Attorney, Agent, or Firm* — Baker & Hostetler LLP

(57) ABSTRACT

A can filling process, the process comprising providing a metal can body (1) having first and second ends, the second end being closed by a peelable lid (2), and supporting the can body (1) from beneath the peelable lid including presenting to the peelable lid a support surface having a pattern embossed thereon. The can body is filled with a product through said first end using a compacting ram such that the peelable lid is pressed against the support surface (3) by the product and said pattern is impressed into the peelable lid (2), and a closure applied to said first end.

8 Claims, 3 Drawing Sheets

(56) References Cited

U.S. PATENT DOCUMENTS 4,122,790 A * 10/1978 Rowe et al. ..... 53/411
4,328,905 A * 5/1982 Hardt ..... 220/258.2
4,369,158 A * 1/1983 Woodruff et al. ..... 264/268
4,650,082 A * 3/1987 Paciorek ..... 215/230
5,229,059 A * 7/1993 Divone et al. ..... 264/267
2004/0134913 A1 * 7/2004 Kronseder et al. ..... 220/257.1
2005/0167430 A1 * 8/2005 Varadarajan ..... 220/258.1
2008/0118720 A1 * 5/2008 Thomas et al. ..... 428/209

* cited by examiner

PROCESS FOR FILLING A CAN

CROSS-REFERENCE TO RELATED APPLICATIONS

This application is the National Stage of International Application No. PCT/EP2012/069872 filed Oct. 8, 2012, which claims the benefit of EP application number 11187538.1, filed Nov. 2, 2011, the disclosures of which are incorporated herein by reference in their entirety.

TECHNICAL FIELD

The present invention relates to a process for filling a can and, more particularly, to a filling process that results in the embossing of a peelable lid.

BACKGROUND

For the canning of some edible products, for example oats, it is usual practice for a can manufacturer to supply to the producer of the edible product an open-bottomed can body that has been pre-sealed with a peelable heat sealed membrane lid over the opening at the top end of the can body, along with a separate can bottom or end. The peelable lid is typically formed of a metal foil, and may be embossed with a pattern or a logo in order to give it an aesthetically pleasing appearance to the consumer. The edible product producer fills the can through the bottom opening before closing the can body by seaming the can bottom over the opening. A plastic overcap is often placed over the top end of the can, directly over the peelable lid, in order to protect the lid. The overcap may be fitted after filling, but usually is pre-fitted to the can body by the can manufacturer in order to reduce the assembly steps that must be performed at the filling facility.

The method described above requires the product to be dispensed into the can body with the can body oriented upside down. As such the product falls and presses down onto the foil lid. Some products are filled under considerable force, for example porridge oats, where a compacting ram is used to force the oats into the can body and to remove air trapped within the product. This is known as "force filling". Force filling directly onto a foil lid can deform the lid, for example forming wrinkles in the foil and damaging any embossed pattern or logo.

It is possible to avoid this problem by providing the can bodies to the filling facility without the foil lids in place, but rather with a pre-seamed bottom. However, this requires that the foil lids be attached at the filling facility and after filling. This is difficult to achieve, not least because it requires the installation of new production equipment at each of the filling facilities (rather than only at a central can production plant).

Moreover, it might not be practical to attach a foil lid after filling if attachment requires access to the can body from both the top and the bottom ends.

SUMMARY

It is an object of the present invention to mitigate the problems that arise from force filling a product directly onto the peelable lid of a can. This object is achieved by providing a lid overcap that incorporates an embossed pattern that is transferred to the peelable lid by the force exerted during the filling process.

According to a first aspect of the invention there is provided a can filling process, the process comprising providing a metal can body having first and second ends, the second end being closed by a peelable lid, and supporting the can body from beneath the peelable lid including presenting to the peelable lid a support surface having a pattern embossed thereon. The can body is filled with a product through said first end using a compacting ram such that the peelable lid is pressed against the support surface by the product and said pattern is impressed into the peelable lid, and a closure applied to said first end.

Embodiments of the present invention are able to improve the appearance of foil lids after filling. Embossing the pattern onto the foil lid at the time of filling may help to avoid disfiguration of the pattern which could occur at the time of filling were the foil lids to be pre-embossed. Furthermore, the manufacturing process may be simplified as the requirement for a separate embossing step, during manufacture of the foil lid, is potentially avoided.

Embodiments of the present invention turn the disadvantage of forcing a peelable lid onto an overcap into an advantage. Rather than some undesirable pattern being created or transferred during the force filling process, a desirable pattern is transferred.

Whilst it is anticipated that the invention will work best with metal foil lids, other lid materials may be available.

The support surface may be provided by an overcap attached to the can body to cover the peelable lid, e.g. a plastic overcap. Alternatively, where no overcap is present, the support surface may be provided by a support plate.

According to a second aspect of the invention there is provided product comprising a metal can body, a closure seamed to a first end of the can body, and a force filled foodstuff contained within an inner space of the can body. The product further comprises a peelable lid closing a second end of the can body, and an overcap attached to the can body at said second end to cover the peelable lid. An embossed pattern is provided on an inner surface of said overcap, opposed to said peelable lid, and that same pattern is impressed into the peelable lid. The peelable lid may be formed of a metal foil.

Figure 5:
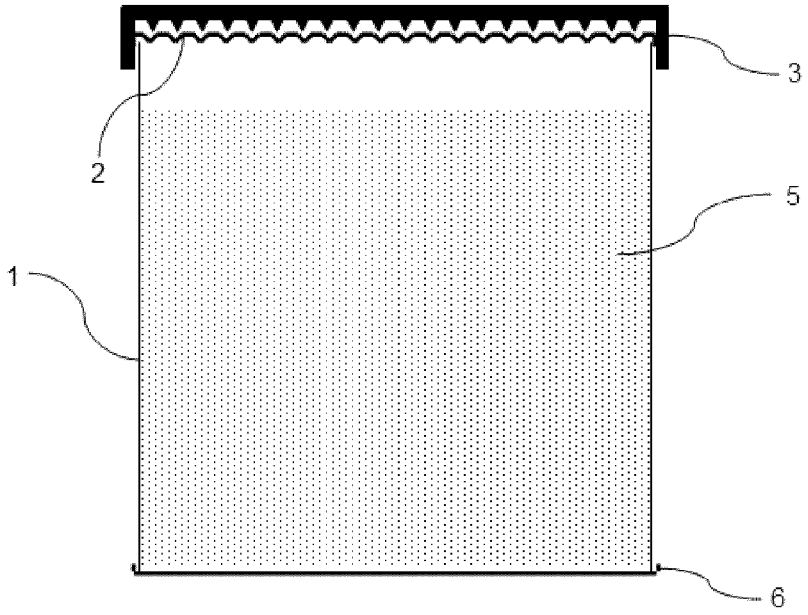

The can as shown in FIG. 5 is in a state that is ready to be shipped to distributors.

DETAILED DESCRIPTION

As previously discussed, a can manufacturer will typically provide to a filling facility a two-part can. A first part comprises the cylindrical metal can body having a foil lid sealed over one end and closed with a plastic overcap, whilst a second part comprises a metal can end suitable for seaming to the open end of the can. As discussed above, force filling is employed during the filling process in order to squeeze additional product in to the can, e.g. by eliminating air pockets. Typically, the plastic overcap is supported from beneath during force filling to prevent rupturing of the lid or damage to the lid seal. However, force filling directly onto the foil lid can cause disfiguration of the lid, e.g. wrinkling or the formation of indents. This is particularly problematic if the lid is provided with a pre-embossed pattern.

An improved process for force filling a metal can will now be described with reference to the figures. The process uses the force exerted on an unembossed ("plain") peelable membrane lid during filling, using a compacting ram, to create an embossed pattern. This is facilitated by supplying the can body with an overcap covering the end of the can body, in contact with or in very close proximity to the foil lid, the overcap having on it's inside surface a "negative" of the pattern to be embossed onto the foil lid.

Figure 1:
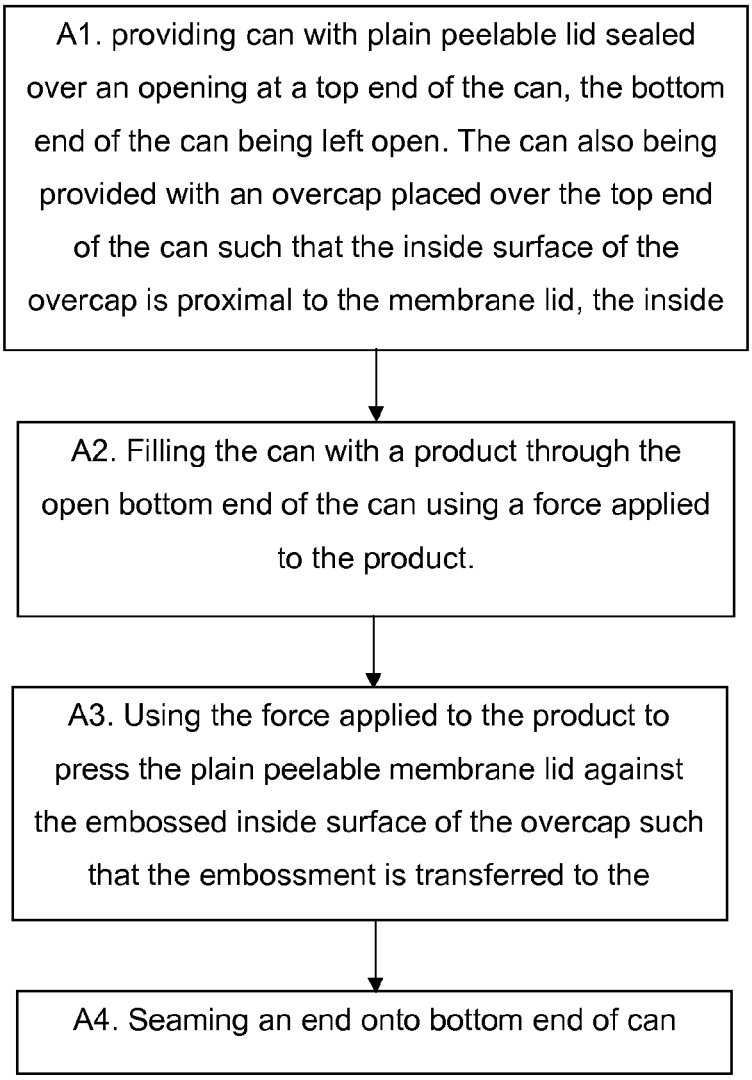
FIG. 1 is a flow diagram illustrating steps of a process for force filling a metal can.

FIG. 1 is a flow diagram illustrating certain steps of a process for force filling a metal can body. The steps of the method are as follows:

A1. Providing a can body with a plain, i.e. unembossed, peelable foil lid, heat sealed over an opening at a top end of the can body, the bottom end of the can body being left open. The can body is also provided with an overcap placed over the top end of the can body such that the inside surface of the overcap is in contact with or in very close proximity to the lid. The inside surface of the overcap is embossed with a pattern to be transferred to the foil lid.

A2. Filling the can body with a product through the open bottom end of the can body using a force applied to the product by a compacting ram (this may involve several filling and compacting stages).

A3. The force applied to the product presses the plain foil lid against the embossed inside surface of the overcap such that the embossed pattern or logo is transferred to the foil lid.

A4. Seaming an end onto the bottom opening of the can body to close the can.

Figure 2:
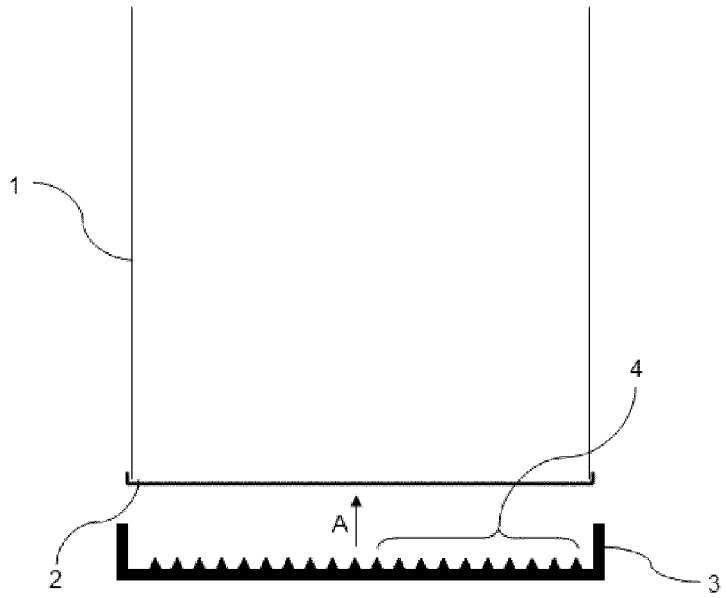
FIGS. 2, 3 and 4 are cross-sectional views of a can during various stages of a force filling process.

FIG. 2 is a cross-sectional view of a generally cylindrical can body 1. The can body 1 will typically be provided by the can manufacturer in a state that is suitable for filling by the food product producer. The producer will have machinery that is capable of filling the can body with the product, and also seaming a bottom end closure on to can body. The can body 1 supplied by the can manufacturer has a plain (i.e. flat or "unembossed") peelable metal foil lid 2 pre-sealed over one end of the can body 1. The foil lid will have been heat sealed to the can body (e.g. to a flange or bead formed at an end of the can body) by the can manufacturer prior to being supplied to the food product producer. Of course, sealing processes other than heat sealing are possible.

The end of the can body 1 to which the peelable lid 2 is sealed is intended to be the top of the can through which the end consumer can access the edible product by peeling off the peelable foil lid. However, during the filling process, as the can is filled through the open bottom, the can is held in an upside-down orientation as illustrated in the Figure. The foil lid is typically formed of a metal foil, although suitable alternatives to metal foil may be used, such as a laminated multilayer membrane. A requirement is that the material is plastically deformable so that it can retain the transferred pattern.

The can body 1 is provided with an overcap 3 that is positioned over the end of the can body 1, as shown by arrow A. The overcap will typically be supplied by the can manufacturer already in position over the end of the can body 1, but it is shown in FIG. 1 as separate from the can body in order that the peelable membrane 2 can be more easily seen. The overcap 3 is typically formed from plastic, and an embossed pattern 4 is provided on the inside surface that is positioned against the peelable membrane lid 2 when the overcap is placed over the end of the can body 1. In FIG. 2 the embossed pattern is a regular grid.

Figure 3:
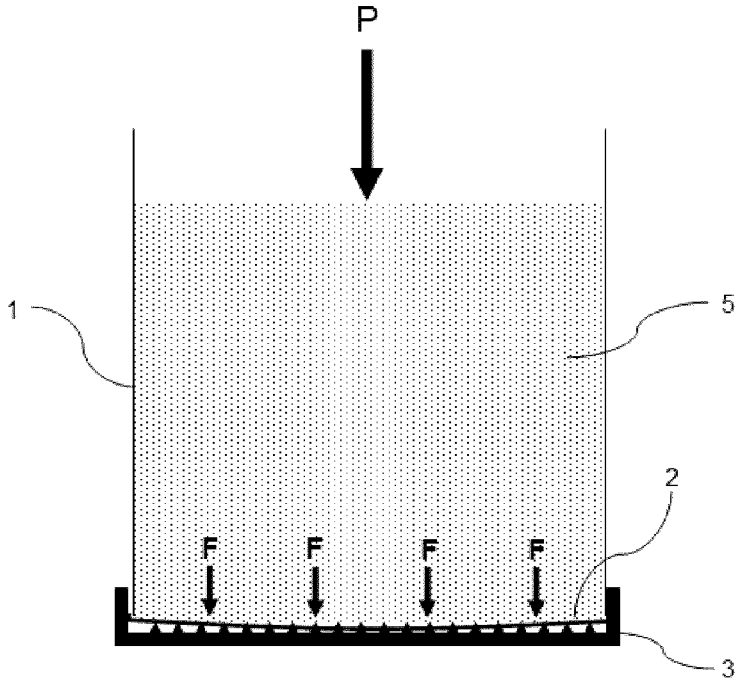

FIG. 3 is a cross-sectional view of the can body of FIG. 2 during steps A2 and A3 of the process described above. The can body 1 is being filled with a product 5 (e.g. a powdered or flaked product) under force P. Force P is typically between 1.5 and 10 kN when force filling metal cans. The force P is transferred through the product 5 to the peelable membrane lid 2, as shown by arrows F. This force F causes the peelable lid 2 to be pushed against the inside surface of the overcap 3. As described in step A3, the embossed pattern 4 is transferred to the peelable lid whilst it is pressed against the overcap 3 due to the deformable, plastic nature of the peelable lid.

Figure 4:
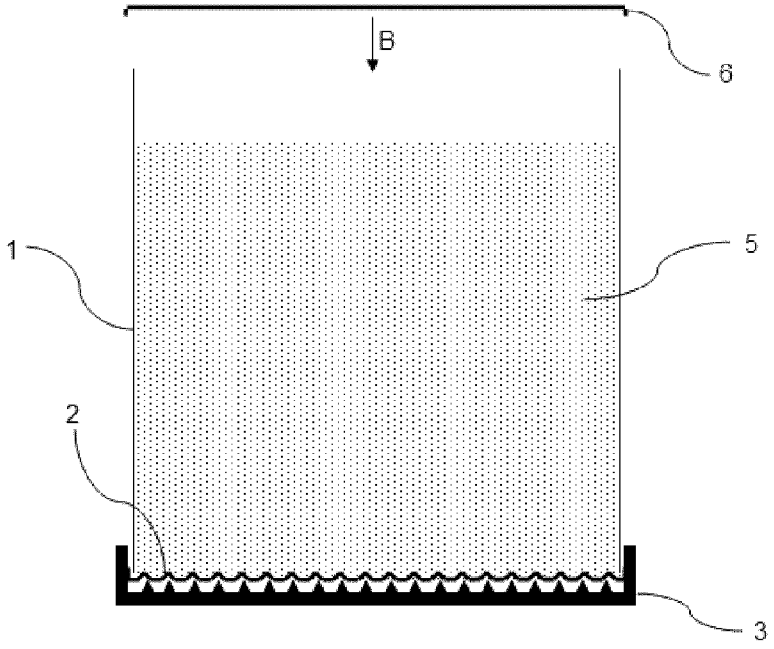

After filling, the can is sealed by seaming a can bottom over the open end of the can body, as shown by arrow B in FIG. 4. The embossed pattern that has been transferred to the peelable membrane lid 2 can be seen in FIG. 4. Once the can body has been closed, it can be turned to the correct orientation, as shown in FIG. 5. In FIG. 5, the overcap 3 is still in position over the top end of the can, protecting the peelable membrane lid 2. The can as shown in FIG. 5 is in a state that is ready to be shipped to distributors.

The embodiments described above refer to an embossed pattern that is provided on the inside surface of the overcap. If the pattern is a company logo or the like, the embossment on the inner surface of the overcap should present a negative version of the logo.

It will be appreciated by the person of skill in the art that various modifications may be made to the above described process without departing from the scope of the present invention. For example, rather than using an overcap to present a pattern to the foil lid during the force filling process, the cap may be omitted and rather the pattern incorporated into a support surface on which the can body is supported. The surface might be an upper surface of a support plate provided as part of the production line.

The invention claimed is:

1. A can filling process for a metal can body having first and second ends, the second end being closed by a peelable lid, the process comprising:

supporting the can body from beneath the peelable lid including presenting to the peelable lid a support surface having a pattern embossed thereon;

filling the can body with a product through said first end using a compacting ram such that the peelable lid is pressed against the support surface by the product and said pattern is impressed into the peelable lid; and applying a closure to said first end.

2. A process according to claim 1, wherein the peelable lid is formed of a metal foil.

3. A process according to claim 1, wherein said pattern embossed on said support surface is a negative image of a logo.

4. A process according to claim 1, wherein said compacting ram exerts a force on the product of between 1.5 and 10kN.

5. A process according to claim 1, wherein said support surface is provided by an overcap attached to the can body to cover the peelable lid.

6. A process according to claim 5, wherein the overcap is formed of a plastic.

7. A process according to claim 5 and comprising, during the filling step, supporting the can body from underneath the overcap.

8. A process according to claim 1, wherein said support surface is provided by a support plate.

* * * * *